United States Patent [19]

Wilke et al.

[11] Patent Number: 4,597,600

[45] Date of Patent: Jul. 1, 1986

[54] DOOR HARDWARE

[76] Inventors: Rudolf Wilke, 4 Marsberger Strasse; Bernd Friedrichs, Remmeker Ring 55, both of 3548 Arolsen, Fed. Rep. of Germany

[21] Appl. No.: 395,977

[22] Filed: Jul. 7, 1982

[30] Foreign Application Priority Data

Jul. 9, 1981 [DE] Fed. Rep. of Germany ..... 3127151

[51] Int. Cl.[4] ..... E05C 21/02

[52] U.S. Cl. ..... 292/336.3; 292/347; 292/351

[58] Field of Search ..... 292/350, 351, 169.22, 292/336.3, 347, 357

[56] References Cited

U.S. PATENT DOCUMENTS

| | | | |
|---|---|---|---|
| 126,004 | 4/1872 | Young | 292/351 |
| 425,743 | 4/1890 | Briggs | 292/351 |
| 943,740 | 12/1909 | Fletcher | 292/351 X |
| 2,759,754 | 8/1956 | Kaiser | 292/357 X |

FOREIGN PATENT DOCUMENTS

| | | | |
|---|---|---|---|
| 149128 | 3/1904 | Fed. Rep. of Germany | 292/351 |
| 2956 | of 1885 | United Kingdom | 292/351 |
| 2289 | of 1886 | United Kingdom | 292/351 |

*Primary Examiner*—Richard E. Moore

[57] ABSTRACT

In door hardware, the handle 1 on the inside of the door and the handle 2 on the outside of the door are interconnected via respective halves 21 and 22 of a handle pin. The door handles can be secured by means of set or clamping screws 25, 26 with the handle halves. Moreover there are two escutcheon plates 6 and 7 which, following the mounting of the hardware to a door panel, are clamped against the door panel. The setscrew 26 for the handle 4 on the outside of the door is arranged in the region behind the outside of the escutcheon plate 7 on the outside of the door, namely preferably in such a way that it is invisible and inaccessible from the outside. The cooperation of the setscrew 26 and the handle pin half 22 permits preferably a finely stepped axial adjustment of the handle pin half with respect to the handle 2 on the outside of the door. The door handle is secure against dismantling from the outside and remains operable in the event of fire.

10 Claims, 6 Drawing Figures

DOOR HARDWARE

The invention relates to door hardware with a handle on the inside of the door and a handle on the outside of the door, which can be interconnected via respective halves of a handle pin to which they can be secured by means of setscrews or clamping screws, and two escutcheon plates which, following the mounting of the hardward to a door panel, can be clamped tight against the door panel.

With known door hardware, the door handles are connected rotatably tightable, i.e., axially stationary, but rotatably with respect to the escutcheon plates. They float axially on the handle pin which is secured axially to the lock by unreliable or cumbersome provisions. This is very disadvantageous particularly with locks that have two follower halves actuated independently of one another by the respectively cooperating door handle. It is evident that in this case it is necessary to have a two-part handle pin, where the two halves are to be rotatable with respect to one another and that with inadequate axial securing of the handle pin the desired cooperation between the respective handle pin halves and the cooperating lock follower halves cannot be guaranteed.

Door hardware is also known in which the handles are connected with the escutcheon plates not rotatably tightable, but with one another via the handle pin only. The pin half on the outside of the door has in this case a series of cross-holes and is secured axially adjustable in steps in the outside handle by means of a cross-screw or cross pin. In the case of a loose handle without an escutcheon plate, this adjustment is possible without any problem. This arrangement has the drawback that the handles hang axially on the handle pin only. This is disadvantageous, because the connection of the inner handle with the inner half of the pin, which must be axially steplessly adjustable, can be subjected to loads to a limited extent only. It is furthermore disadvantageous that the seating of the handles cannot be assembled prior to delivery. The tolerances can therefore not be selectively narrowed down and the bearing cannot be reliably greased. Disadvantageous is further that the handle becomes axially displaceable if, in the event of fire, the door wood is burnt wholly or partly on one side of the lock. As a result the handle pin halves may become disengaged from their cooperating follower halves or engaged with a non-cooperating follower half.

The object of the present invention resides in providing an improved door hardware that is capable of bearing a high mechanical load, that is secure against dismantling from the outside of the door and that remains operable in the case of fire. The operability of the hardware is to be guaranteed even if all plastics components melt or are consumed by fire and if, in addition, the wood of the door burns away on one side of the lock.

To solve this object there is being propsed a door hardware according to one or several of the appended claims.

The invention and its attendant advantages are explained in greater detail below with reference to the drawing in which.

Figure 1:
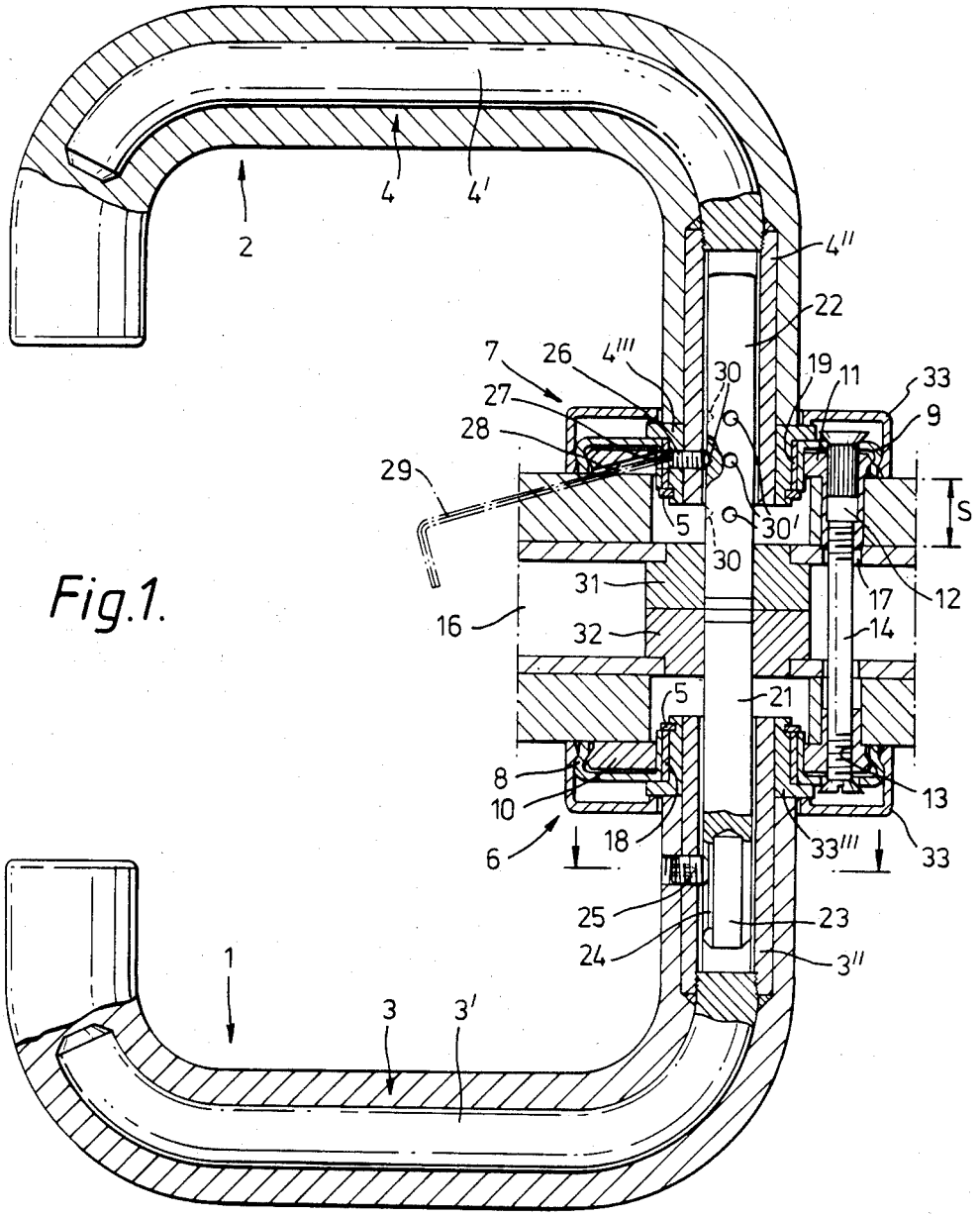
FIG. 1 shows a horizontal section through door hardware according to the invention.
Figure 2:
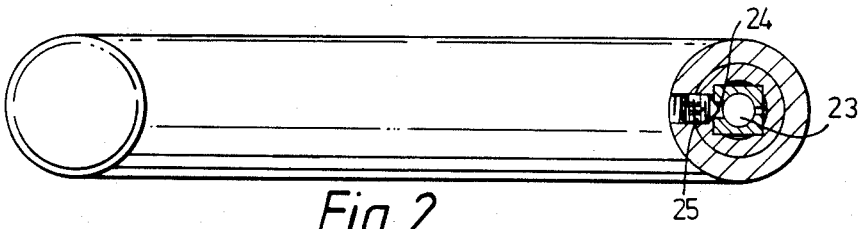
FIG. 2 shows a cross-section through the door hardware of FIG. 1 in the sectional plane II—II.
Figure 3:
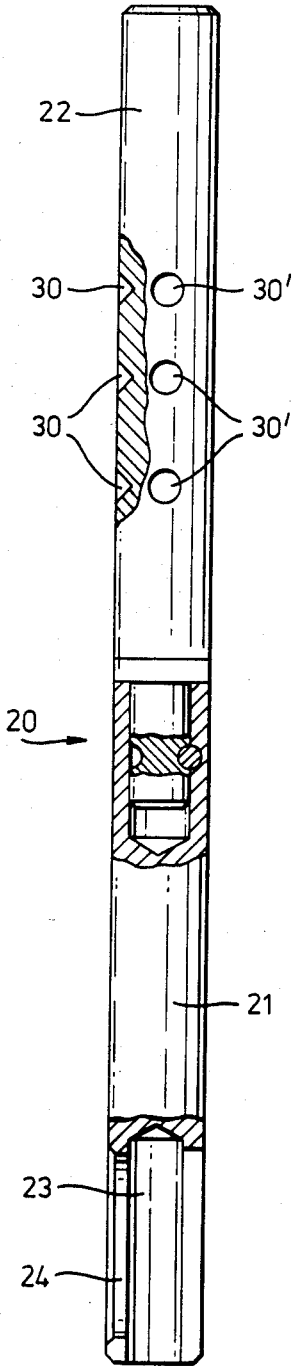
FIGS. 3 and 4 show detailed and, in the case of FIG. 3, partially cut-away views of a possible embodiment of a two-part thrust pin that is used preferably with the door hardware according to the invention.
Figure 4:
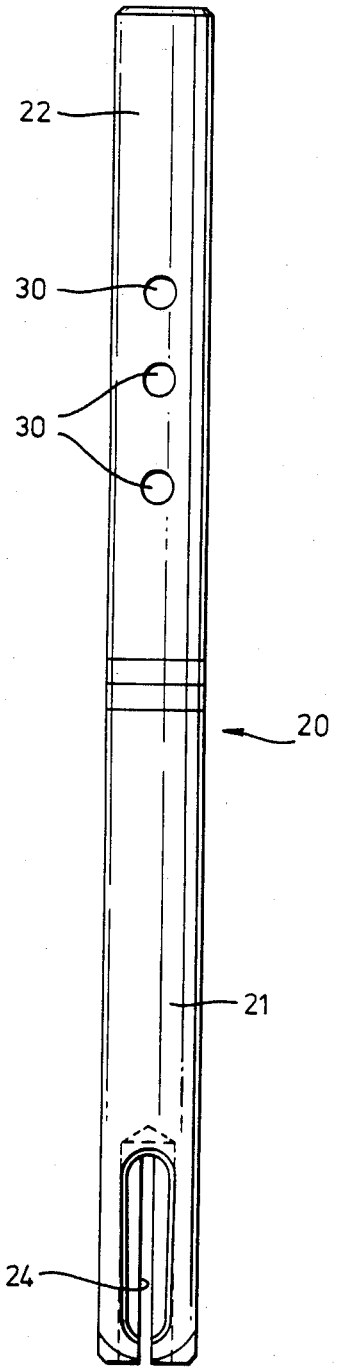

The handle 1 on the inside of the door and the handle 2 on the outside of the door, which are preferably made of plastics material, have in per se known manner steel inserts 3 and 4 that are welded together out of bent round bars 3' and 4', cylindrical sleeves with square holes 3'' and 4'' and bushings 3''' and 4'''.

The two handles are, by means of circlips 5, connected to be rotatably tightable with the escutcheon plates 6 and 7. These escutcheon plates have steel base parts 8 and 9 in which fillers 10 and 11 are inserted, preferably by snap connection.

The inner escutcheon plate 6 has at least 2 screwholes 13 for continuous mounting screws 14 that are screwed into threaded sleeves 12 of the outer escutcheon plate 7. Since the door lock 16 does not in all instances have passages 17 for continuous screws, the outer escutcheon plate 6 has discretionally or additionally likewise screwholes so that, if necessary, both escutcheon plates can be screwed on even with short screws.

Cover caps 33 cover the escutcheon plate base parts. They are mounted onto the base parts by snap connection.

To improve the sliding conditions, there can be provided in the region of the handle bearing between the escutcheon plate base parts 8 and 9 and the steel bushings 3''' and 4''' plastics bushings 18 and 19 that are preferably firmly connected with the steel bushings 3''' and 4'''.

All of this—even in this combination—is already known.

The handle pin consists of an inner half 21 and an outer half 22 which, likewise in per se known manner, can be connected with one another by rotatable tightening "(swivel-spindle)".

The inner pin half 21 has at its free end a front-side bore 23 and a slot 24 outwardly enlarged by inclined planes. If a cross-screw 25 arranged in the throat of the inner handle 1 is tightened, its tip penetrates into the slot 24 and clamps the pin half 21 radially and axially firmly in the inner handle 1 (per se known).

A similar cross-screw 26 is situated in the throat of the handle 2 on the outside of the door, namely in the throat section situated in the escutcheon plate (or possibly behind the escutcheon plate). With the escutcheon plate not yet fastened to the door, this screw can, in accordance with the invention, be turned via a passage 27 in the collar of the escutcheon plate base part 9 and possibly a recess 28 in the filler 11 with a key or a screwdriver 29 possibly applied at a slight angle. Discretionally, the screw can be arranged at a slight angle or it can be shifted rearwardly so far that it is accesible without oblique positioning.

The tip of the screw 26 which is secured by suitable means against becoming loose of its own accord, engages one of a plurality of short cross bores 30 arranged in series in the pin half 22.

Following loosening of the screw 26, the pin half 22 can be axially displaced in the handle 2 and subsequently be re-secured in one of the positions predetermined by the cross-bores 30. In this way, the handle pin can with different wood thicknesses S be always so adjusted above the door lock that the pin half 22 engages on the one hand adequately deeply its cooperating lock follower half 31 but does, on the other hand, not engage with the inner lock follower half 32.

If necessary, on other side faces of the pin half 22 additional cross-bores 30' can be provided that, with respect to the cross bores 30 are staggered in such a way that a very finely stepped adjustment is possible.

The assembly is very simple. Prior to the screwing on of the escutcheon plates, the handle pin 20 is—as a function of the thickness of the wood S above the lock—slid to the required depth into the outer handle 2 and secured in the proper position by the tightening of the screw 26.

Subsequently the outer and the inner hardware is screw-tightened on the door panel and the cover caps are forced on. Finally, the cross-screw 25 is tightened.

The hardware according to the innovation is characterized by a combination of the following characteristics:

1. Both handles are connected so that they can be rotatably tightened with their escutcheons or plates and are additionally tensioned with one another via the handle pin.

2. The handle pin can be axially adjusted in fine steps in the outer handle, with the setscrew 26, owing to its arrangement in a region of the handle situated in (or possibly behind) the escutcheon plate, being invisible and inaccessible following assembly.

3. The handle pin is axially steplessly adjustable in the inner handle.

These characteristics result—in combination with the additional structural design—in the following advantages in use:

A. The hardware can be subjected to heavy mechanical loads since the axial forces acting upon the handle are absorbed by the escutcheon plate setscrews and by the handle pin.

B. Even if the escutcheon plate can only be screwed on onto the outside of the door (in the case of locks without openings) the hardware is secured against dismantling from the outside of the door by the pin connection that cannot be detached from the outside.

C. In the event of fire, the hardware remains operable if all plastics parts melt or are consumed in the fire. It remains operable even if in addition the wood of the door is consumed by fire on one side of the lock since, even in this case, none of the two handle halves and none of the two pin halves becomes axially displaceable.

In lieu of the two-part handle pin there can be provided a one-part pin. The design according to the invention has in this case the advantage that with one length of pin it is possible to bridge a wider range of door thicknesses.

Figure 5:
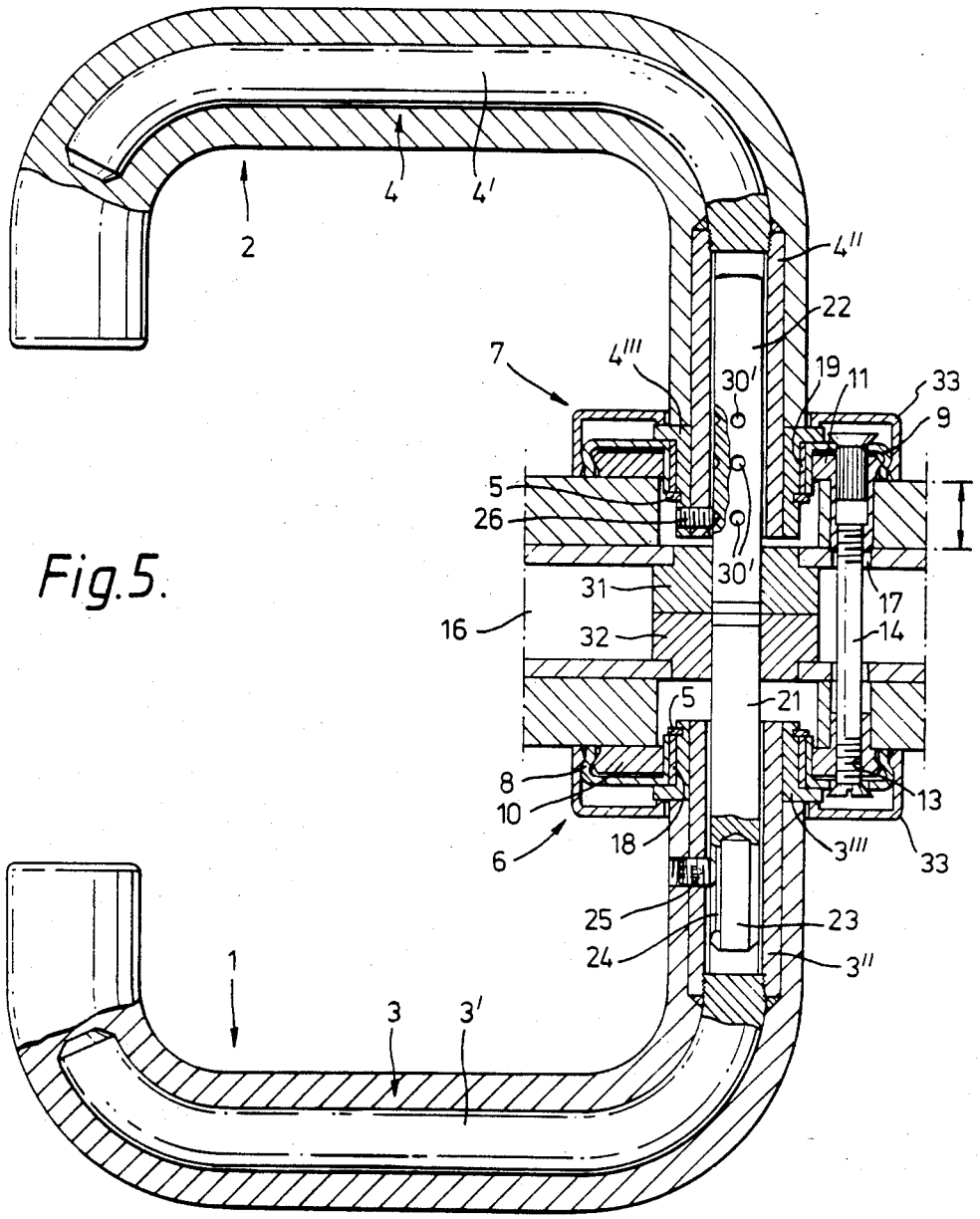
FIG. 5 shows a horizontal section through another embodiment of the door hardware according to the invention.

As an alternative of, e.g., the FIGS. 1 to 4, the setscrew 26 can be arranged behind the outer escutcheon plate 7, if the pressure throat is extended correspondingly, as shown in FIG. 5. In the case of this variant, one must put up with the disadvantage that in the event of reduced thickness S of the wood, the handle may, on account of its larger structural length, abut against the lock follower, at least then when the bearing of the handle projects already beyond the rear side of the escutcheon plate, which is desirable in the interest of a longer and thus tilt-resistant and wear-resistant mounting.

Figure 6:
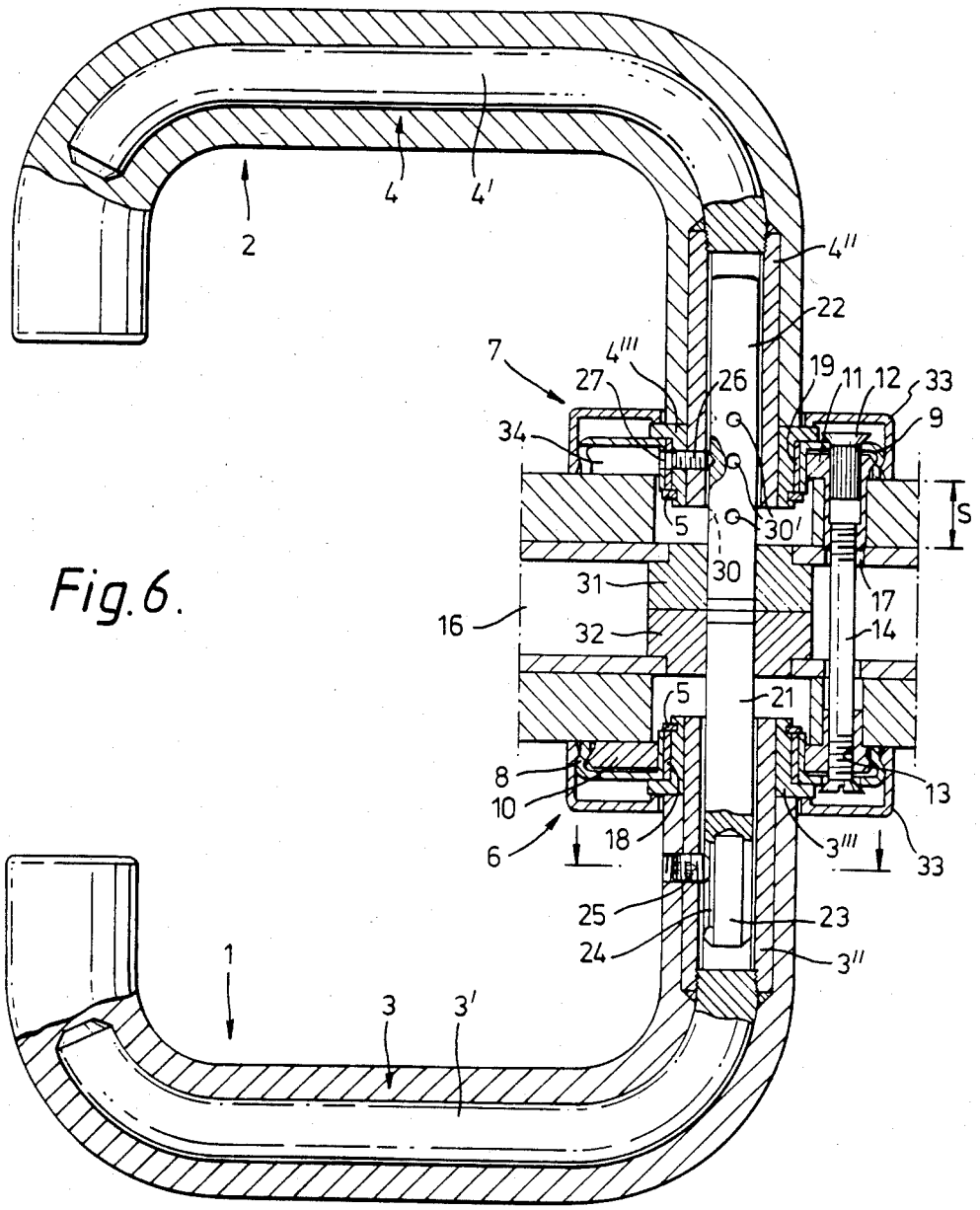
FIG. 6 shows a horizontal section through a third embodiment of the door hardware according to the invention.

With another variant (FIG. 6) the screw 26 is arranged somewhat further forward so that it is accessible via a radial recess 34 even if the escutcheon plate is screwed on. The assembly security of this arrangement can be enhanced in that the radial recess is blocked following tightening of the screw 26. This can be brought about for instance by a subsequent rotating of the filler 11 with respect to the steel base part 9. Such an arrangement of the screw 26 can be advantageous in connection with another hardware.

We claim:

1. Door hardware including an inside base part, first means for clamping said inside base part against the inside surface of a door, an outside base part, second means for clamping said outside base part against the outside surface of said door, a spindle adapted to extend through said door and having first and second sections, said sections being axially stationary but rotatably joined to each other, an inside door handle being mounted to said inside base part axially stationary, but rotatably with respect to said inside base part and having a first hollow end portion fitted onto said first spindle section, an outside door handle being mounted to said outside base part axially stationary, but rotatably with respect to said outside base part and having a second hollow end portion fitted onto said second spindle section, first means for enabling an axial adjustment and locking of said inside door handle on said first spindle section and second means for enabling an axial adjustment and locking of said outside handle on said second spindle section, said second clamping means including internally screw threaded sleeves extending through holes in said second base part and towards the door from one side thereof, and said first clamping means including mounting screws extending through screwholes in said inside base part and into the door from the opposite side thereof and being screwed for threaded engagement into said threaded sleeves.

2. Door hardware including an inside base part, first means for clamping said inside base part against the inside surface of a door, an outside base part, second means for clamping said outside base part against the outside surface of said door, a spindle adapted to extend through said door and having first and second sections, said sections being axially stationary but rotatably joined to each other, an inside door handle being mounted to said inside base part axially stationary, but rotatably with respect to said inside base part and having a first hollow end portion for being fitted onto said first spindle section, an outside door handle being mounted to said outside base part axially stationary, but rotatably with respect to said outside base part and having a second hollow end portion for being fitted onto said second spindle section, first means for enabling an axial adjustment and locking of said inside door handle on said first spindle section, second means for enabling an axial adjustment and locking of said outside handle on said second spindle section, and a cover cap, said cover cap and said outside base part having cooperating means securing said cover cap to said outside base part by means of a snap connection, said cover cap being being designed for covering said outside base part such that said second handle cannot be dismounted from the outside surface of said door when said inside and outside base parts, said inside and outside handles and said spindle are fully mounted on said door and said cover cap is mounted on said outside base part.

3. Door hardware according to claim 1, wherein said outside base part is covered with a cover cap.

4. Door hardware according to claim 2, wherein said second clamping means includes internally screw threaded sleeves extending through holes in said second base part and towards the door from one side thereof, and said first clamping means include mounting screws extending through screwholes in said inside base part and into the door from the opposite side thereof being screwed for threaded engagement into said threaded sleeves.

5. Door hardware according to claims 1 or 2, wherein said second adjustment and locking means have a set screw screwed into the outside handle and being adapted to be tightened against said second spindle section, said set screw being covered by said outside base part when said inside and outside base parts, said inside and outside handles and said spindle are fully mounted on said door.

6. Door hardware according to claim 5, wherein said set screw is located such that it can only be turned via a passage in said outside base part.

7. Door hardware according to claim 5, wherein said outside base part has a filler being rotatably mounted within said outside base part and wherein said set screw is located such that it can only be turned via a radial recess extending through said outside base part and said filler.

8. Door hardware according to claim 5, wherein said spindle has a polygonal cross section and that rows of recesses are provided in its sidewalls, said rows being axially staggered with respect to one another and said recesses being provided for receiving said set screw.

9. Door hardware according to claim 3, wherein said cover cap is securable to said outside base part by means of a snap connection.

10. Door hardware according to claim 1 or 2, wherein said first and second base parts consist of steel parts, and wherein said handles consist of plastic material parts having steel inserts, each insert including a bent bar forming a handle portion, a cylindrical sleeve comprising a respective one of said hollow end portions and a bushing connected thereto for rotatably mounting said handles in said respective base parts.

* * * * *